United States Patent [19]

Bower et al.

[11] 4,139,326

[45] Feb. 13, 1979

[54] MINE ROOF SUPPORTS

[75] Inventors: Lewis R. Bower; Malcolm Wake, both of Wakefield, England

[73] Assignee: Fletcher Sutcliffe Wild Limited, Horbury Yorks, England

[21] Appl. No.: 897,632

[22] Filed: Apr. 18, 1978

[30] Foreign Application Priority Data

Apr. 26, 1977 [GB] United Kingdom ..... 17442/77

[51] Int. Cl.[2] ..... E21D 15/44

[52] U.S. Cl. ..... 405/292

[58] Field of Search ..... 61/45 D; 299/31–33; 248/357; 91/170 MP

[56] References Cited

U.S. PATENT DOCUMENTS

| | | | |
|---|---|---|---|
| 3,324,664 | 6/1967 | Allen | 61/45 D |
| 3,357,742 | 12/1967 | Dommann et al. | 61/45 D X |
| 3,383,866 | 5/1968 | Groetschel | 61/45 D |
| 4,030,308 | 6/1977 | Dudley et al. | 248/357 |

*Primary Examiner*—Dennis L. Taylor

*Attorney, Agent, or Firm*—Lowe, King, Price & Becker

[57] ABSTRACT

A mine roof support comprises a plurality of hydraulically extensible chock legs articulated at upper ends thereof to one or more roof beams and at lower ends thereof to one or more base members, a shield pivotally connected to a rearward part of the base member(s) and also pivotally connected to a rearward part of the roof beam(s) with a permanently loaded force applying means reacting via the shield on the roof beam(s), in such a manner that the force applying means resists displacement of the roof beam(s) and, upon a sufficient fall in pressure in the chock legs, restores any displaced chock legs to a predetermined position.

14 Claims, 5 Drawing Figures

2
3
4
5
6
7
8
9
9
10
11
12
13
14
15
16
17
18
19
20

8
8A
3
21
11
5
5
11
3
8A
8

8
16
9
32
12
2
4
3
10
20
6
7
5

MINE ROOF SUPPORTS

This invention relates to a mine roof support of the kind incorporating a plurality of hydraulically extensible chock legs articulated at upper ends thereof to one or more roof beams, and at lower ends thereof to one or more base members.

Such supports are commonly used in the longwall mining of minerals, notably coal by being spaced along a mineral face, with an armoured conveyor interposed between the supports and the face, the supports being connected to the conveyor by one or more double-acting advancing rams to advance the individual pans thereof towards the newly exposed mineral face, after passage of the mineral winning device, with the supports in their roof supporting condition. Conversely, when it is required to advance the supports towards the advanced conveyor, the pressure in the chock legs is allowed to fall, to release wholly or partially the roof beam(s) from the roof and the supports pulled forward by the advancing ram(s) reacting on a conveyor, usually with the roof beam(s) in some slight frictional contact with the roof.

In practice, however, there is relative movement between the mine roof and the mine floor, while there also exists the possibility of the roof beam(s) striking a roof projection, whilst the support is advancing. Both these effects result in the upper ends of the chock legs being displaced. The displacement is usually rearwardly or a combination of rearward and lateral displacement, but forward displacement is not unknown in certain conditions. To avoid damage to the clock leg by displacement, several proposals have been put forward aimed not only at accommodating a few degrees of displacement, but also serving to restore the chock legs to a pre-determined position, upon release of the support from the roof. However, such restoration proposals have usually incorporated a restoration device reacting between the base member(s) of the support and at least one chock leg thereof. This of necessity results in the introduction of bending loads and stresses into the chock leg(s).

According to the present invention, a mine roof support comprises a plurality of hydraulically extensible chock legs articulated at upper ends thereof to one or more roof beams and at lower ends thereof to one or more base members, a shield pivotally connected to a rearward part of the base member(s) and also pivotally connected to a rearward part of the roof beam(s), with a permanently loaded force applying means reacting via the shield on the roof beam(s), in such a manner that the force applying means resists displacement of the roof-beam(s) and, upon a sufficient fall in pressure in the chock legs, restores any displaced chock legs to a predetermined position.

Thus, the proposals of the invention avoids the transmission via the chock legs of the forces necessary to restore a roof beam(s) to a predetermined position and/or to provide some initial resistance to such roof beam/chock leg displacement. The permanent loading of the force applying means also has the result that restoration from a displaced position is commenced or even completed part way through chock leg release, while the roof beam(s) is still in contact with the roof, and when the restoration forces become greater than the frictional forces between the roof beam(s) and the roof.

Preferably, the shield member is pivotally connected via a link mechanism to the base member. The link mechanism may comprise two parallel, or generally parallel links, one above the other, and preferably located at each side of the support, within the overall width of the support.

According to a first embodiment, the force applying means is suspended from the roof beam(s) and reacts on an upper portion of the shield. Although the force applying means may take the form of one or more springs, rubber blocks, gas capsules etc. preferably such means takes the form of one or more permanently pressurised hydraulic piston and cylinder units. When in the form of a hydraulic piston and cylinder unit, the latter is provided with a check valve for admission of fluid and with a relief valve to yield when a predetermined pressure is attained. Preferably, two such units are employed, both inclined in opposite directions with respect to the centre line of the support, so that lateral as well as rearward displacement forces may be initially resisted, and if displacement occurs, restoration effected.

According to a first construction, in an initial, predetermined and non-diplaced condition, the piston rod of each unit is fully extended and bears on a transverse pin located at the upper end of the shield, the pin passing through a longitudinally extending slot in brackets carried at each side of the roof beam, so that should rearward roof beam displacement for instance occur, the brackets move with the beam, the pin and piston remaining stationary while the cylinder slides over the piston, the annulus volume being enlarged. The maximum allowable inclination occurs when the piston and cylinder units have been fully retracted. When the roof support is retracted from the roof, readmission of pressure fluid to the full bore sides of the piston and cylinder units, to replace that exhausted during roof beam displacement, causes the units to react on the shield to restore the roof beam(s) to the predetermined position. Such re-admission may be automatically effected by permanently connecting the full bore sides of the piston and cylinder unit to the hydraulic mains.

According to a second construction, the or each piston and cylinder unit comprises two opposed pistons, preferably having a common hydraulic supply. With two angularly inclined units of this form, forward displacement forces as well as rearward and lateral displacement forces can be initially resisted and if displacement occurs, restoration effected.

In detail, a cylinder common to both pistons of the or each unit may be readily attached to, and suspended from, the underside of the roof beam(s). The cylinder may be housed within a wrap-around box attached to the shield, the box having at each end thereof a reaction pad, onto one of which pads a projecting piston rod of each piston bears, the pads being so spaced apart that the piston rods just bear in their maximum position of extension from the cylinder i.e. when no displacement of the roof beam has taken place, or after the roof beam has been restored from a displaced condition. Conveniently, each end of the cylinder is suspended from the roof beam(s) by a pair of spaced apart, depending lugs from the beam(s) embracing an upstanding lug from the cylinder end, with a common supporting pin passing through co-axial holes in these three elements. Conveniently, one of the pins is of extended length to pass through a slotted hole in each of two side walls of the box, thereby slidably supporting the box at that location, with the box pivotally attached at its other end to the shield. Preferably, in addition to the pistons being urged apart by the common hydraulic fluid between them, a common compression spring also extends between them. Thus, the cylinder(s), being carried by the beam(s), is displaced in accordance with the beam(s) displacement, whilst the box remains stationary, thereby forcing one or other of the pistons into the cylinder with the resultant increase in pressure of the fluid contained therein until a desired maximum pressure is reached when the relief valve opens, the permanent pressurization of the cylinder(s) automatically forcing out of the cylinder the piston retracted by beam(s) displacement, during the beam(s) restoration effect.

In accordance with a second embodiment, the force applying means is constituted by one of the links at each side of the support being a hydraulic piston and cylinder unit.

In an initial, non-displaced condition the piston rod is fully retracted, the annulus side being pressurised, and extends during displacement of the beams.

It will be appreciated that with both the first and second embodiment, if either accommodates and restores only rearward or rearward and lateral movement, one may readily reverse the mode of operation of the restoration piston and cylinder unit(s) is the less frequent occurance of forward roof movement is encountered, by pressurising the other side of the piston head to that pressurised for rearward roof movement. Thus for universal use, the units may be made double acting.

The shield may be generally channel shaped adapted, in the retracted condition of the roof support, to telescope over a built up rear base portion of the support which portion becomes increasingly exposed as the shield is lifted until the roof beam(s) engages the mine roof.

Embodiments of mine roof supports in accorance with the invention will now be described in greater detail, by way of example, with reference to the accompanying drawings in which.

In all Figures, like components are allocated like reference numerals.

Figure 1:
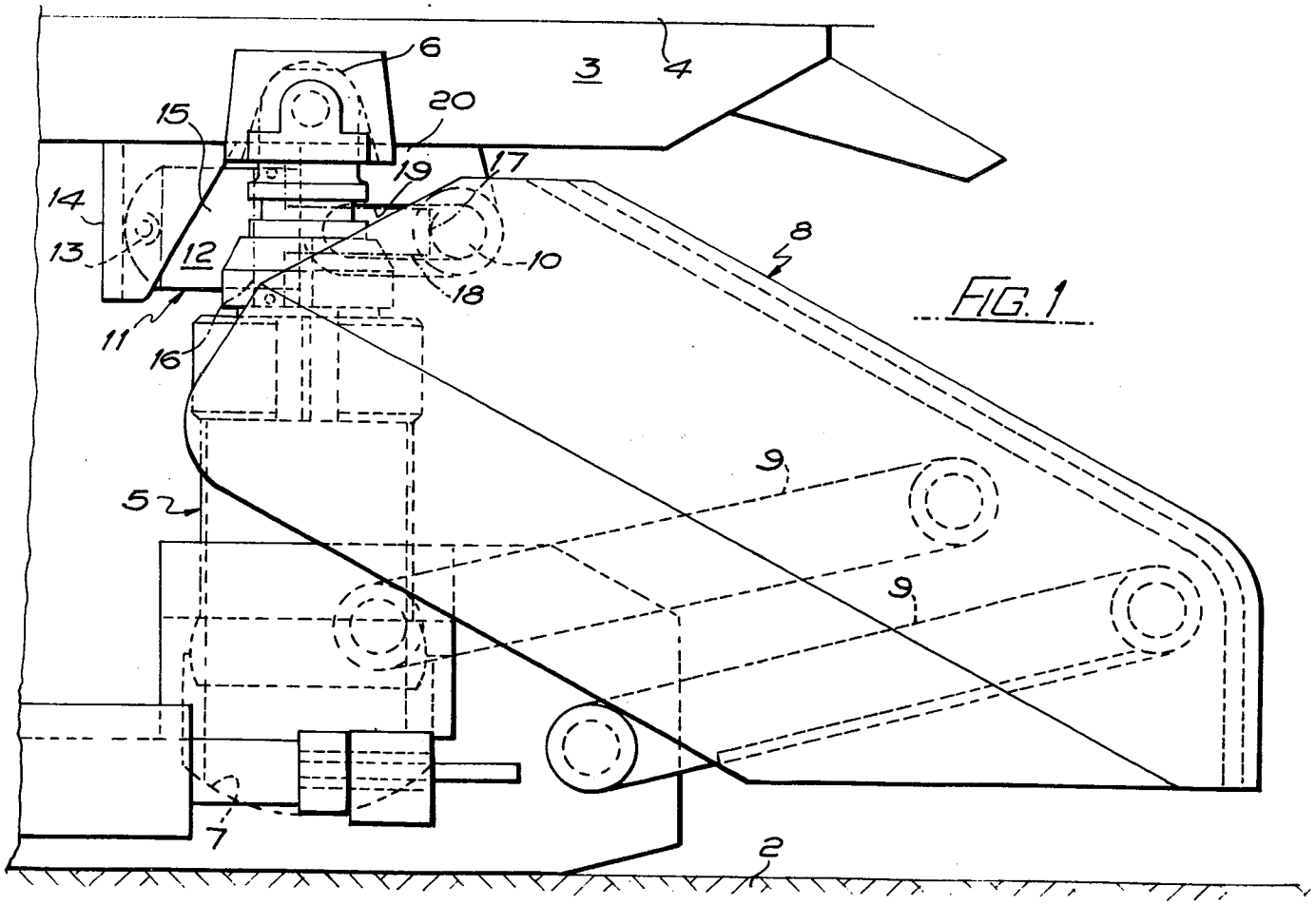
FIG. 1 is a side elevation of the rear end of a first embodiment of a four-leg, hydraulically powered mine roof support.

In FIG. 1, the mine roof support can be seen to comprise a base member 1 seated on a mine floor 2 with a roof beam 3 in engagement with a mine roof 4, the base member 1 and roof beam 3 being spaced apart by two forwardly located, hydraulically extensible chock legs (not shown) and two similar rearwardly located chock legs 5. Each chock leg is articulated to both the base member 1 and the roof beam 3 at known joints incorporating arcuate bearing surfaces 6 and 7. A shield 8 is pivotally connected to a rearward part of the base member 1 by being mounted at each side on pairs of upper and lower parallel links 9, while the shield is also pivotally attached to a rearward part of the roof beam 3, by means of a pivot pin 10.

Figure 2:
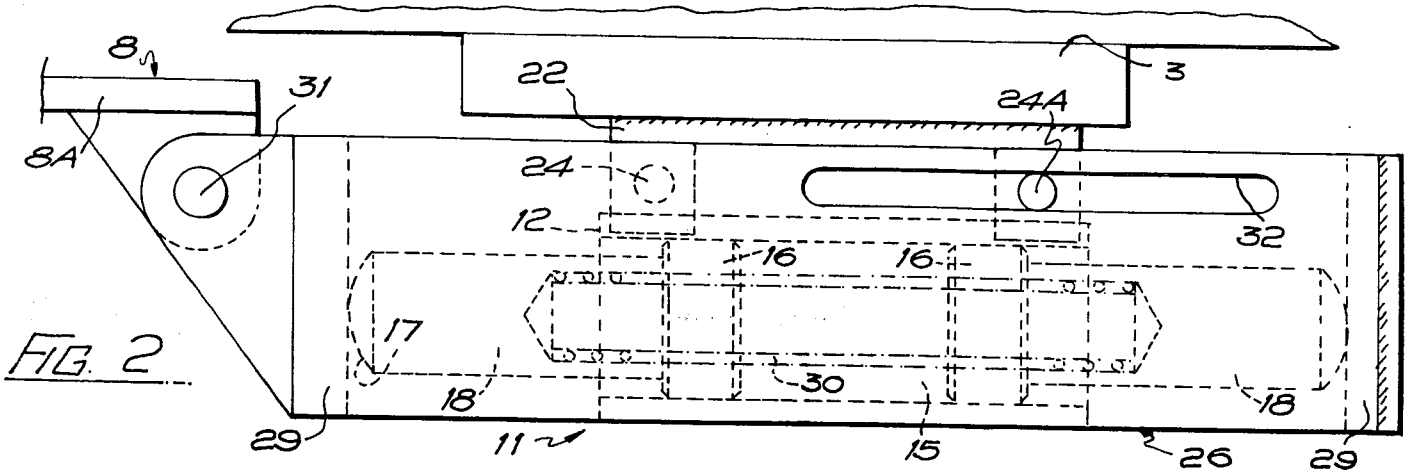
FIG. 2 is a side elevation of an alternative restoration device to that shown in FIG. 1.

In the embodiment of FIG. 1, the roof support incorporates to spaced apart force applying means 11, each means comprising a cylinder 12 pivotally secured at 13 to a bracket 14 depending from the underside of the roof beam 3, the full bore cavity 15 of the cylinder 12 being permanently pressurised with hydraulic fluid so that piston 16 is normally urged to the position shown in chain dotted line, with the result that an end 17 of a piston rod 18 engages the pin 10, ends of the latter engaging a slot 19 in a bracket 20 which is also secured to the underside of the roof beam 3. As shown in FIG. 2, each force applying means 11 is located along an axis inclined with respect to the centre line 21 of the roof support.

In FIG. 1, the roof support and its roof beam 3 is shown in a non-displaced condition. If and when rearward displacement of the upper end of the chock legs 5 occurs e.g. by natural rearward movement of the roof 4, or during advance of the roof support towards a mineral face, the pin 10 remains stationary, or substantially so, due to the non-movement of the shield 8, while the force applying means 11, being carried by the roof beam 3, moves rearwardly. Thus, the pin 10 blocks corresponding movement of the piston rod 18, thereby increasing the pressure of the fluid within the full bore cavity 15 of the cylinder 12, this pressure increase continuing until a maximum design pressure is reached whereupon a relief valve (not shown) opens, resistance to rearward displacement of the beam 3 being continued by the force applying means 11 until such time as the piston 16 is fully retracted into the cylinder 12. Upon release or retraction of the chock legs 5, the permanent pressurisation of the full bore cavities 15 by a supply line (not shown), has the automatic effect of extending the piston rod 18 from the cylinder 12 as restoration is effected by the piston end 17 reacting on the pin 10.

Figure 3:
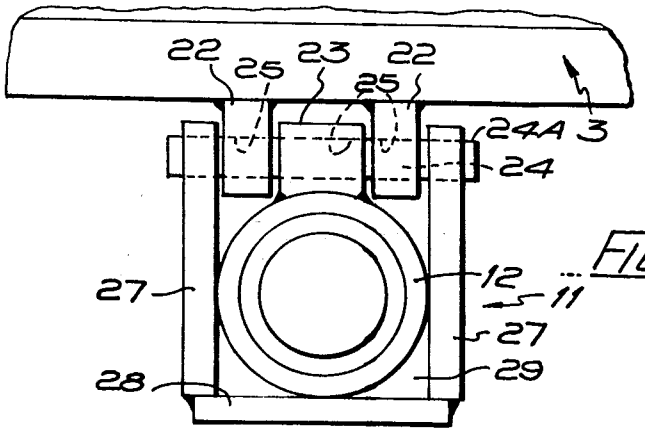
FIG. 3 is an end elevation of FIG. 2.

In the alternative embodiment shown in FIGS. 2 and 3, each force applying means 11 has each end of its cylinder 12 supported from the underside of the roof beam 3 by a pair of spaced apart depending lugs 22 embracing a projecting lug 23 attached to the cylinder 12, while a common support pin 24 passes through co-axial holes 25 and the three elements 22, 23. The cylinder 12 is housed in a wrap-around box 26 comprising two spaced apart, parallel sidewalls 27, a floor 28 and at each end of the box, a reaction pad 29 engaged by the end 17 of each piston rod 18, the two pistons 16 being common to the cylinder 12 with hydraulic fluid in the full bore cavity 15 being common to both pistons. Besides the latter being urged apart by the action of the hydraulic fluid, they are also urged apart by a common compression spring 30. The box 26 is secured to an element 8A of the shield 8 on a pivot pin 31, while each sidewall 27 is provided with an elongate slot 32 through which slot pass extended ends 24A of one pin 24, for box guidance purposes.

In use, the cylinder of each unit 11, being carried by the beam 3, is displaced in accordance with beam displacement, while the box 26 remains stationary, thereby forcing one or other of the pistons 16 into the cylinder 12 until the fluid in the full bore cavity 15 reaches the predetermined pressure set by a relief valve (not shown) when relief occurs, the permanent pressurisation of the full bore cavity 15 automatically forcing out of the cylinder 12 whichever piston was previously retracted into the cylinder by beam displacement, thereby providing the beam restoration effect by reacting, through the associated pad 29 and hence the box 26 on the shield 8.

Figures 4, 5:
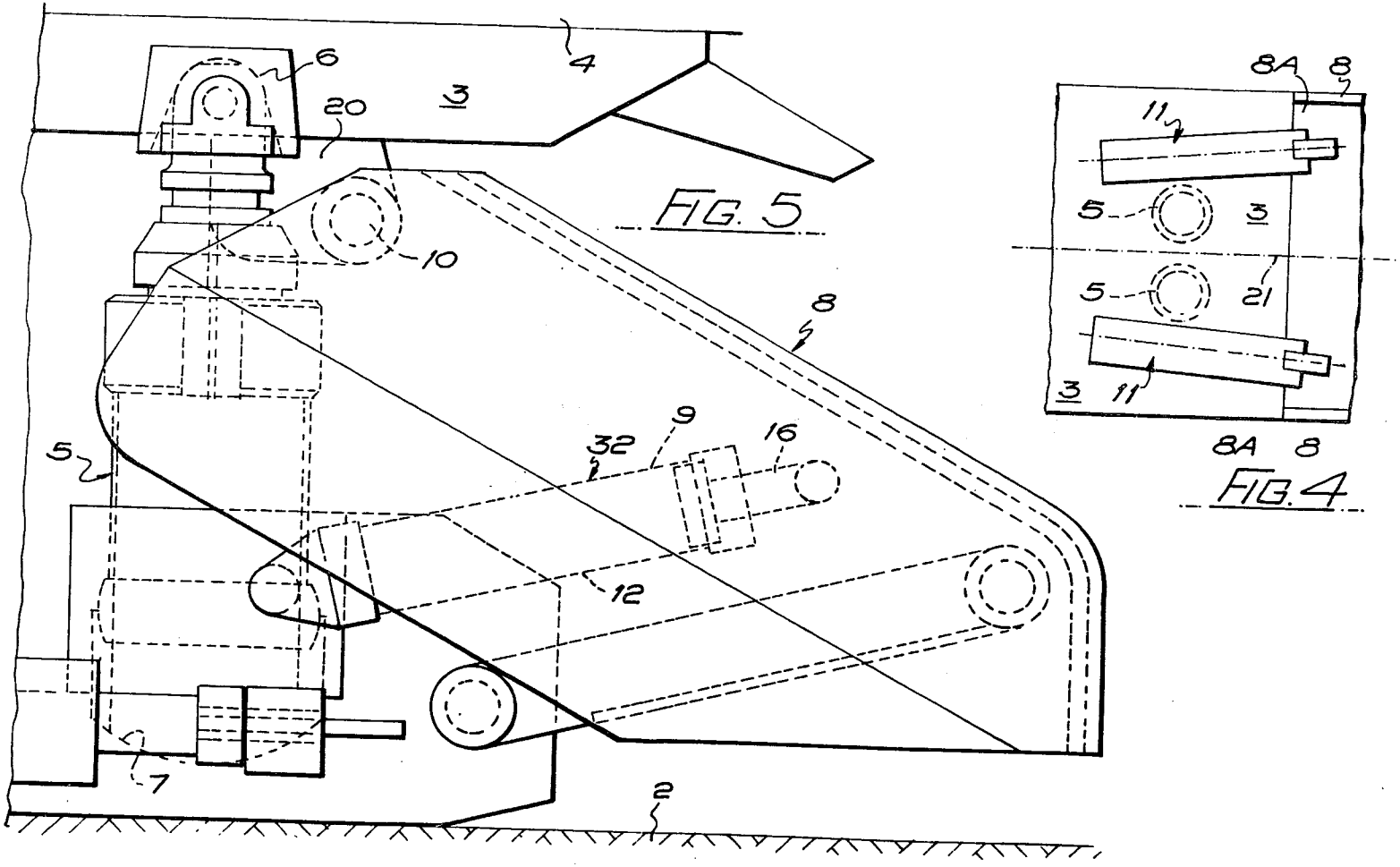
FIG. 4 is a plan view of the rear end of a four leg hydraulically powered mine roof support in-corporating two restoration devices of the embodiment of FIGS. 2 and 3 and FIG. 5 corresponds to FIG. 1 but shows a second embodiment of mine roof support.

In the embodiment of FIG. 4, the force applying means 11 is constituted by a pair of hydraulic piston and cylinder units 32 located at each side of the roof support, pivotally connected between the base member 1 and the shield 8, and constituting upper links. In the initial non-displaced condition illustrated, the annulus side of the piston 16 is premanently pressurised, so that the piston rod 18 is fully retracted. Should any forces act on the roof beam 3 to force the latter and hence the upper ends of the chock legs 5 in a rearward direction, these forces are transmitted via the shield 8 to the means 11 and such forces are resisted by the reluctance of the piston rods 18 to extend. Should the piston rods 18 be extended by the magnitude of forces on the roof beam 3 producing in the annulus sides a pressure exceeding yield pressure with the consequent opening of the associated yield valve, the upon release of pressure in the chock legs 5, the permanent connection of the annulus side to a mains pressure supply ensures retraction of the piston rods 18 and hence restoration of the roof beam 3 and chock legs 5 to their predetermined position.

What we claim is:

1. A mine roof support comprising at least one roof beam, at least one base member, a plurality of hydraulically extensible chock legs articulated at upper ends thereof to said roof beam and at lower ends thereof to said base member, a shield pivotally connected to a rearward part of said base member and also pivotally connected to a rearward part of said roof beam, with a permanently loaded force applying means reacting via said shield on to said roof beam, in such a manner that said force applying means resists displacement of said roof beam and, upon a sufficient fall in hydraulic pressure in said chock legs, restores any displaced chock legs to a predetermined position.

2. A mine roof support as claimed in claim 1, wherein a link mechanism pivotally connects said shield member to said base member.

3. A mine roof support as claimed in claim 2, wherein said link mechanism comprises two parallel links located one above the other, and at each side of said support, within the overall width of said support.

4. A mine roof support as claimed in claim 1, wherein said force applying means is suspended from said roof beam and reacts on an upper portion of said shield.

5. A mine roof support as claimed in claim 1, wherein said force applying means takes the form of permanently pressurised hydraulic piston and cylinder units.

6. A mine roof support as claimed in claim 5, where said unit is provided with a check valve for admission of fluid and with a relief valve to yield when a predetermined pressure is attained.

7. A mine roof support as claimed in claim 5, wherein two of said units are employed, both inclined in opposite directions with respect to the centre line of said support.

8. A mine roof support as claimed in claim 5, wherein said unit comprises two opposed pistons.

9. A mine roof support as claimed in claim 8, wherein aid pistons have a common hydraulic supply.

10. A mine roof support as claimed in claim 8, comprising two of said units inclined in opposite direction with respect to the centre line of said support.

11. A mine roof support as claimed in claim 8, wherein a cylinder common to both said pistons of said unit is attached to, and suspended from, said roof beam.

12. A mine roof support as claimed in claim 11, wherein a wrap-around box attached to said shield, houses said cylinder, a reaction pad is provided at each end of said box on to one of which pads a projecting piston rod of each of said pistons bears, said pads being so spaced apart that said piston rods just bear in their maximum position of extension from said cylinder.

13. A mine roof support as claimed in claim 2, wherein said force applying means is constituted by one of said links at each side of said support being a hydraulic piston and cylinder unit.

14. A mine roof support as claimed in claim 1, wherein said shield is generally channel-shaped and adapted, in the retracted condition of the roof support, to telescope over a built up rear base portion of said support.

* * * * *